US006843478B1

(12) United States Patent
Hoepelman

(10) Patent No.: US 6,843,478 B1
(45) Date of Patent: Jan. 18, 2005

(54) TOSSING BALL GAME

(76) Inventor: Rene Hoepelman, 2004 Bathgate Ave., 1st floor, Bronx, NY (US) 10457

( * ) Notice: Subject to any disclaimer, the term of this patent is extended or adjusted under 35 U.S.C. 154(b) by 0 days.

(21) Appl. No.: 10/642,555

(22) Filed: Aug. 18, 2003

(51) Int. Cl.[7] ..... A63B 63/04
(52) U.S. Cl. ..... 273/342; 273/354
(58) Field of Search ..... 273/342, 343, 273/348, 348.4, 352, 353, 317, 398, 400, 401, 118 R, 126 R, 123 R, 286, 298

(56) References Cited

U.S. PATENT DOCUMENTS

| | | | | | |
|---|---|---|---|---|---|
| 3,643,950 | A | | 2/1972 | Holk | |
| 3,951,409 | A | | 4/1976 | Drodomirecky | |
| 4,726,592 | A | | 2/1988 | Callaham | |
| 4,804,192 | A | | 2/1989 | Matsumoto et al. | |
| 4,826,177 | A | * | 5/1989 | Ponte | 273/400 |
| 4,863,176 | A | * | 9/1989 | Lapkewych | 273/348.4 |
| 5,052,693 | A | * | 10/1991 | Hicks | 273/336 |
| 5,112,048 | A | | 5/1992 | Kienle | |
| 5,290,040 | A | | 3/1994 | Boroski | |
| 5,566,948 | A | * | 10/1996 | Kidd | 273/342 |
| 5,707,062 | A | * | 1/1998 | Perillo et al. | 273/354 |
| 5,765,832 | A | * | 6/1998 | Huff | 273/354 |
| 2003/0227137 | A1 | * | 12/2003 | Girard et al. | 273/404 |

* cited by examiner

*Primary Examiner*—Gregory Vidovich
*Assistant Examiner*—Nini F. Legesse
(74) *Attorney, Agent, or Firm*—Donald R. Schoonover

(57) ABSTRACT

A game is played using a target unit that has at least two target holes defined therein and a plurality of protrusions thereon. A game ball is thrown at the target unit and either enters a target hole, rebounds from the target unit, or misses the target unit. Players are divided into teams and each team is awarded points if a player from that team successfully tosses the game ball into a target hole. Time limits can be imposed for the overall game, the time allotted for a team to throw a ball, or the like. A player is charged with fouls for leaving a designated player area, contacting another player or the like, and can be disqualified from the game if that player accumulates too many fouls. The target can be modular and can be rotated during play.

18 Claims, 2 Drawing Sheets

TOSSING BALL GAME

BACKGROUND OF THE INVENTION

1. Field of the Invention

The present invention relates to the general art of amusement devices and games, and to the particular field of such games which include aerial projectiles.

2. Discussion of the Related Arts

Many people, especially children, enjoy participating in various games. More specifically, many people enjoy playing games which involve tossing a game ball at a target.

While some people enjoy competition in such games, not all people wish to play a competitive game. In order to be most versatile, a game should be amendable to being played either competitively or non-competitively.

Therefore, there is a need for a tossing ball game that can be played either competitively or non-competitively.

Many people also enjoy a game that can be played at various levels of difficulty. This permits the game to be played by people of varying skill levels, and introduces an element of strategy into the game.

Therefore, there is a need for a tossing ball game that can be played at various levels of difficulty.

PRINCIPAL OBJECTS OF THE INVENTION

It is a main object of the present invention to provide a tossing ball game which can hold a player's attention.

It is another object of the present invention to provide a tossing ball game that can be played either competitively or non-competitively.

It is another object of the present invention to provide a tossing ball game that can be played at various levels of difficulty.

SUMMARY OF THE INVENTION

These, and other, objects are achieved by a game which includes throwing a game ball at a target unit which has at least one hole in it and a plurality of protrusions on it. Points are awarded if the ball passes through a hole. The players on the opposing side struggle to take possession of the ball and the game continues. If the ball gets stuck inside the tube, it is passed on to a player of the opposing team. Points are awarded to the player or team who threw the ball in. If the ball does not go through, it will likely hit one of the protrusions and rebound in an unpredictable manner. The game is set up so that players can divide themselves into teams and pass the ball to a player who is in a good position to throw the ball into a hole in the target. Time limits, rules and the like are included to maintain interest and equality in playing conditions.

Players of all skill levels and interest can participate and the game can be altered to account for player skills and/or objectives.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Figure 1:
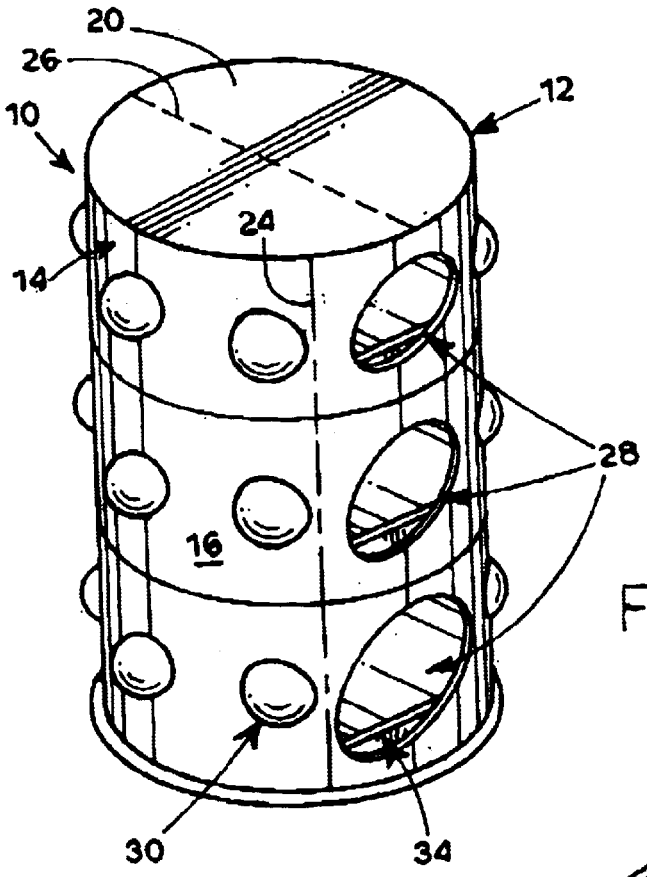
FIG. 1 is a perspective view of a target unit included in the game embodying the present invention.
Figure 2:
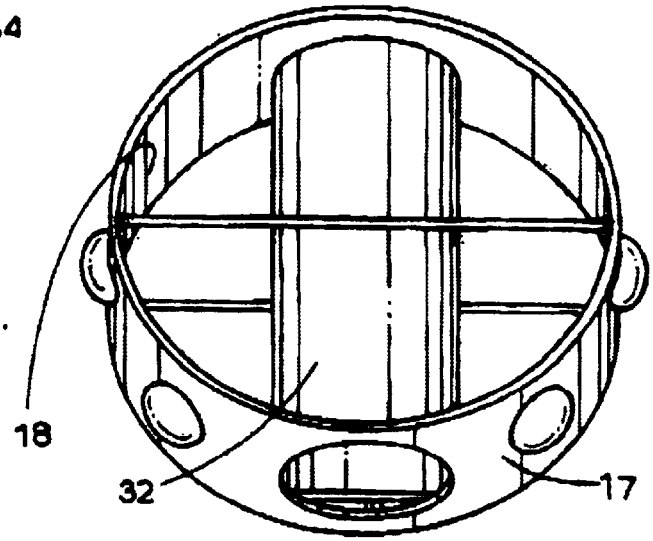
FIG. 2 is a perspective view showing the inside of one module of the target unit.
Figure 3:
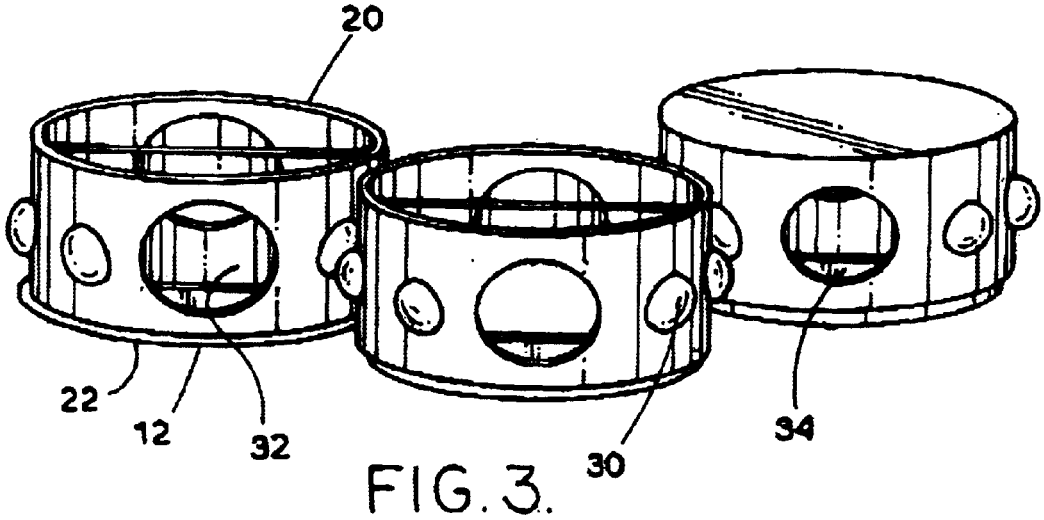
FIG. 3 shows a plurality of target modules.

Referring to the Figures, it can be understood that the present invention is embodied in a game and equipment used to play that game. The equipment comprises a target unit 10 which includes a hollow tubular target element 12. The target element 12 is modular and includes a plurality of identical modules, such as module 14. The modules 14 can be stacked and attached to each other if desired. Each module 14 of the target element 12 has a tubular wall 16, which is shown in FIG. 1 as being cylindrical, but can also be polygonal or other desired profile without departing from the scope of the present disclosure. As indicated in FIG. 2, each module 14 is hollow. Each module 14 includes an outer surface 17 of the tubular wall 16, an inner surface 18 of the tubular wall 16, a first end 20, a second end 22, and a longitudinal axis 24, which extends between the first end and the second end 22. A diameter dimension 26 extends transverse to the longitudinal axis 24.

Two target holes, such as target holes 28, are defined through the tubular wall 16. The target holes 28 are located on opposite ends of the diameter dimension 26. As can be understood from FIG. 1, the target holes 28 in each module 14 can be sized to be different, either larger or smaller, than the target holes 28 in adjacent modules 14. However, the target holes 28 in a single module 14 are the same size as each other.

A plurality of semispherical protrusions, such as protrusion 30, are located on the outer surface 17 of the tubular wall 16. The protrusions 30 are located on the upper and lower parts of the holes and are spaced apart from each other. The purpose of the protrusions 30 will be understood from the teaching of the present disclosure.

As shown in FIG. 2, a connecting tube 32 connects the two target holes 28 together and extends along the diameter dimension 26 of the target element 12.

A dam element 34 is mounted on the connecting tube 32 adjacent to each target hole 28. The dam element 34 occludes a portion of the target hole 28 adjacent thereto.

The equipment further includes a playing field 40, which includes an arcuate outer boundary 42 having a perimeter 44, an arcuate inner boundary 46 located inside the perimeter 44 of the outer boundary 42 and a target unit accommodating location 48 positioned within the inner boundary 46. Target unit 10 is located at the target unit accommodating location 48. In one form of the invention, the playing field 40 slopes downwardly from the outer boundary 42 to the inner boundary 46.

The playing field 40 further includes a plurality of player boundary areas, such as player boundary area 50. Each player boundary area 50 extends radially between the inner boundary 46 and the outer boundary 42. Each player boundary area 50 includes a sub-boundary area 52 located adjacent to the outer boundary 42 from which a player throws the ball from the mound. In one form of the invention, a mound, such as mounds 54, is located in the sub-boundary area 52. The playing field 40 can be marked as desired to accommodate the number of players by using chalk or the like.

Figure 4:
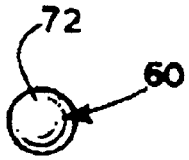
FIG. 4 shows a game ball which is included in the game embodying the present invention.
Figure 5:
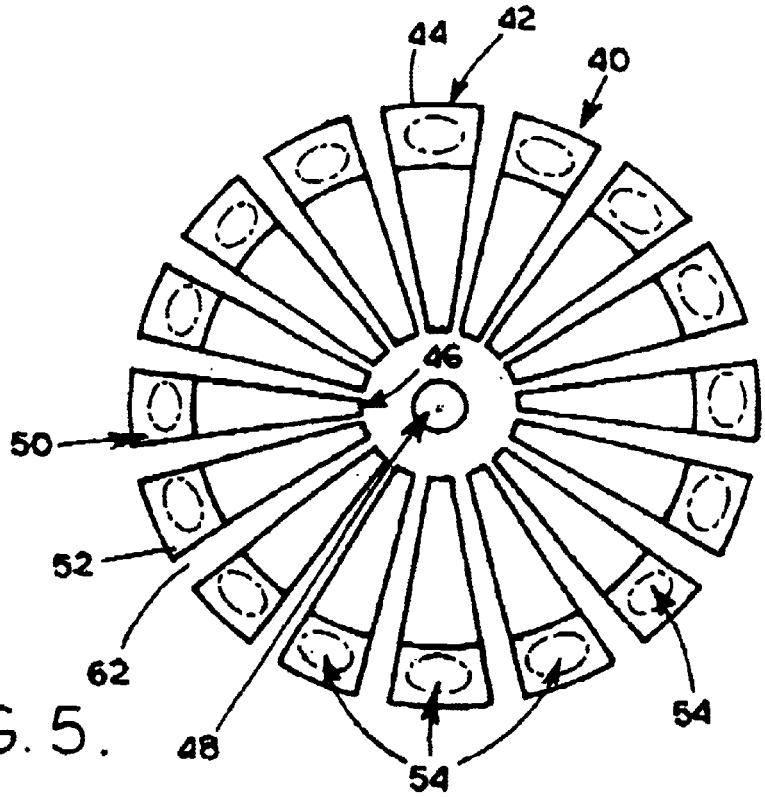
FIG. 5 is a top plan view of a playing field which is included in the game embodying the present invention.

As shown in FIG. 4, the equipment also includes a game ball 60. The game ball 60 can be formed of resilient material, such as rubber or the like, and the playing field 40 can be formed of fabric material such as carpet or cloth 62 or the like, which is supported on a substrate, such as the ground or the like. Other forms of the invention include hard playing areas which can be formed of plastics material or the like. Those skilled in the art can visualize the materials required based on the teaching of the present disclosure.

In another form of the invention, the game target unit 10 can be mounted to rotate about longitudinal axis 24 during a game to change the difficulty level of the game.

A method for playing a game using the above-described equipment comprises locating the target unit 10 in the target accommodating location 48; locating a player in each of a plurality of first sub-boundary areas 52; dividing the players into at least first and second teams; designating one player from the first team as the initial player; having the initial player throw the game ball 60 at the target unit 10 and trying to throw the ball 60 into one of the target holes 28; if the game ball 60 enters into a target hole 28, awarding points to the player who threw the game ball 60 before the game ball 60 entered the target hole 28; it will bounce in an unpredictable manner. Players from both teams will struggle to gain possession of the ball. Once the ball is possessed by a player, he or she can pass it to a team mate. If the game ball 60 does not enter a target hole 28, having a player associated with the second team catch the game ball 60; requiring a player from the second team to throw the game ball 60 at the target unit 10 within a specified time period after the game ball 60 is caught.

Points are awarded to the team according to which target hole 28 the ball successfully enters. If a team exceeds its time limit to throw the ball 60 at the target 10, possession of the ball passes to the other team. If the ball 60 hits a protrusion 30, it will take odd and unpredictable bounces, which adds to the enjoyment of the game. If the target unit 10 is rotating, the difficulty of the game is increased, and if the players are located on sloping ground or on mounds 54, the game difficulty is also changed. If the ball 60 strikes a dam 34 on the way out of the target unit 10, further difficulties and unpredictability are introduced into the game. One method of playing the game of the present invention includes allowing all players to compete for a rebounding ball 60 if a shot is missed.

Further interest in the game can be generated by including various steps which include designating an overall playing time, and subdividing the overall playing time into quarters, halves and the like. Still further interest can be generated by including a step of designating a team time limit and if one team does not throw the game ball 60 at the target unit 10 within the team time limit, awarding possession of the game ball 60 to a player of the opposing team. The speed of the game is increased by limiting the time permitted to initiate a shot, thereby increasing interest. A player can only hold the ball 60 for a very limited amount of time before he or she must pass or shoot the ball 60. The method for playing a game embodying the present invention can further include a step of charging a player with a foul if the player moves out of the player boundary area 50 associated with the player, or charging a foul to any player who contacts another player and disqualifying players who accumulate a preset number of fouls.

The method for playing a game embodying the present invention further includes a step of awarding possession of the game ball 60 to one team or another team if the game ball 60 becomes stuck in the tube 32, the player who tossed the ball is awarded points, but possession of the ball passes to a player of the opposing team.

The target holes 28 are shown in FIG. 1 as being aligned with each other along the longitudinal axis; however, these target holes 28 can be offset from each other if desired. Also, more than two target holes 28 per module can be used and/or some modules can include one target hole 28 if desired without departing from the scope of the present invention. The protrusions 30 are of the same size.

It is understood that while certain forms of the is present invention have been illustrated and described herein, it is not to be limited to the specific forms or arrangements of parts described and shown.

What is claimed and desired to be covered by Letters Patent is:

1. A game comprising:

a) a target unit which includes a hollow tubular target element, the target element having
  (1) a tubular wall,
  (2) an outer surface on the tubular wall,
  (3) an inner surface on the tubular wall,
  (4) a first end,
  (5) a second end,
  (6) a longitudinal axis extending between the first end and the second end,
  (7) a diameter dimension that extends transverse to the longitudinal axis,
  (8) two target holes defined through the tubular wall, the target holes being located on opposite ends of the diameter dimension,
  (9) a plurality of semispherical protrusions on the outer surface of the tubular wall, the protrusions being located between the two target holes, the protrusions being spaced apart from each other,
  (10) a connecting tube connecting the two target holes together, the connecting tube extending along the diameter dimension of said target element, and
  (11) a dam element mounted on the connecting tube adjacent to each target hole, the dam element occluding a portion of the target hole adjacent thereto;

b) a playing field which includes
  (1) an arcuate outer boundary having a perimeter,
  (2) an arcuate inner boundary located inside the perimeter of the outer boundary,
  (3) a target unit accommodating location positioned within the inner boundary, said target unit being located at the target unit accommodating location,
  (4) a plurality of player boundary areas, each player boundary area extending radially between the inner boundary and the outer boundary, each player boundary area including a sub-boundary area located adjacent to the outer boundary and in which a player is required to remain during a game; and c) a game ball.

2. The game as described in claim 1 further including a plurality of target elements.

3. The game as described in claim 1 wherein the target unit is cylindrical in shape.

4. The game as described in claim 1 further including a mound located in each sub-boundary area.

5. The game as described in claim 1 wherein said playing field slopes from the outer boundary towards the inner boundary.

6. The game as described in claim 1 wherein the target element is mounted to rotate about the longitudinal axis.

7. The game as described in claim 1 wherein said playing field is mounted on a base and the base is adapted to be supported on a supporting surface.

8. A method for playing a game comprising:

a) providing a target unit which includes a hollow tubular target element, the target element having
(1) a tubular wall,
(2) an outer surface on the tubular wall,
(3) an inner surface on the tubular wall,
(4) a first end,
(5) a second end,
(6) a longitudinal axis extending between the first end and the second end,
(7) a diameter dimension that extends transverse to the longitudinal axis,
(8) two target holes defined through the tubular wall, the target holes being located on opposite ends of the diameter dimension,
(9) a plurality of semispherical protrusions on the outer surface of the tubular wall, the protrusions being located between the two target holes, the protrusions being spaced apart from each other,
(10) a connecting tube connecting the two target holes together, the connecting tube extending along the diameter dimension of said target element, and
(11) a dam element mounted on the connecting tube adjacent to each target hole, the dam element occluding a portion of the target hole adjacent thereto;

b) providing a playing field which includes
(1) an arcuate outer boundary having a perimeter,
(2) an arcuate inner boundary located inside the perimeter of the outer boundary,
(3) a target unit accommodating location positioned within the inner boundary, said target unit being located at the target unit accommodating location,
(4) a plurality of player boundary areas, each player boundary area extending radially between the inner boundary and the outer boundary, each player boundary area including a sub-boundary area located adjacent to the outer boundary and in which a player is required to remain during a game;

c) providing a game ball;

d) locating the target unit in the target accommodating location;

e) locating a player in each of a plurality of first sub-boundary areas;

f) dividing the players into at least first and second teams;

g) designating one player from the first team as the initial player;

h) having the initial player throw the game ball at the target unit and trying to throw the ball into one of the target holes;

i) when a player tosses the ball, requiring the other players to not obstruct, hit, or try to touch the ball when it is on its way to the target holes; and j) requiring a player from the second team to throw the game ball at the target unit within a specified time period after the game ball is caught.

9. The method for playing a game as described in claim 8 further including a step of rotating the target unit.

10. The method for playing a game as described in claim 8 further including designating an overall playing time.

11. The method for playing a game as described in claim 10 further including a step of subdividing the overall playing time.

12. The method for playing a game as described in claim 8 further including a step of designating a team time limit and if one team does not throw the game ball at the target unit within the team time limit, awarding possession of the game ball to another team.

13. The method for playing a game as described in claim 8 further including charging a player with a foul if the player moves out of the player boundary area associated with the player.

14. The method for playing a game as described in claim 13 further including charging a foul to any player who intentionally bumps another player.

15. The method for playing a game as described in claim 14 further including disqualifying players who accumulate a preset number of fouls.

16. The method for playing a game as described in claim 8 further including a step of awarding possession of the game ball to one a player of the opposing team if the game ball becomes stuck in the tube.

17. The method for playing a game as described in claim 8 further including awarding possession of the game ball to one team or another if the game ball moves over the outer boundary.

18. The method for playing a game as described in claim 8 further including the step of awarding points to a player who throws the game ball through the tube.

* * * * *